US009574301B2

(12) United States Patent
Kitamura

(10) Patent No.: US 9,574,301 B2
(45) Date of Patent: Feb. 21, 2017

(54) INK JET ETCHING METHOD AND INK JET PRINTING SYSTEM

(71) Applicant: Seiko Epson Corporation, Tokyo (JP)

(72) Inventor: Kazuhiko Kitamura, Matsumoto (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 14/658,748

(22) Filed: Mar. 16, 2015

(65) Prior Publication Data

US 2015/0267346 A1 Sep. 24, 2015

(30) Foreign Application Priority Data

Mar. 18, 2014 (JP) ..... 2014-054539
Mar. 26, 2014 (JP) ..... 2014-063237
Nov. 21, 2014 (JP) ..... 2014-236554

(51) Int. Cl.
*D06Q 1/02* (2006.01)
*B41J 2/01* (2006.01)
*B41J 2/16* (2006.01)
*D06P 5/30* (2006.01)

(52) U.S. Cl.
CPC . *D06Q 1/02* (2013.01); *B41J 2/01* (2013.01); *B41J 2/162* (2013.01); *B41J 2/1606* (2013.01); *D06P 5/30* (2013.01)

(58) Field of Classification Search
None
See application file for complete search history.

(56) References Cited

U.S. PATENT DOCUMENTS 3,874,958 A * 4/1975 Scholtis ..... D06Q 1/02 156/155
5,796,416 A * 8/1998 Silverbrook ..... B41J 2/005 347/47
7,267,426 B2 9/2007 Miyajima et al.
2004/0238487 A1* 12/2004 Kiehlbauch ..... C03C 15/00 216/52
2005/0100705 A1* 5/2005 Kiff ..... D06P 5/12 428/89
2008/0150975 A1* 6/2008 Ueno ..... B41J 2/04576 347/9
2011/0193900 A1* 8/2011 Aruga ..... B41J 2/16526 347/6
2011/0217892 A1* 9/2011 Chabrecek ..... B41F 15/34 442/60

(Continued)

FOREIGN PATENT DOCUMENTS

GB 635157 * 4/1950
JP 63-066386 A 3/1988

(Continued)

*Primary Examiner* — Shamim Ahmed
(74) *Attorney, Agent, or Firm* — Harness, Dickey & Pierce, P.L.C.

(57) ABSTRACT

An ink jet etching method according to the invention includes an etching step of etching fabric by using an ink set including first etching ink containing an etching agent, and second etching ink containing the etching agent in which a concentration of the etching agent is lower than a concentration of the etching agent in the first etching ink, in which etching fabric includes ejecting the first etching ink is ejected from two or more nozzle arrays among a plurality of nozzle arrays included in a recording head.

13 Claims, 3 Drawing Sheets

(56) References Cited

U.S. PATENT DOCUMENTS

| | | | | |
|---|---|---|---|---|
| 2014/0050899 | A1* | 2/2014 | Kukoff | B32B 38/10<br>428/195.1 |

FOREIGN PATENT DOCUMENTS

| | | | |
|---|---|---|---|
| JP | 63-072585 | A | 4/1988 |
| JP | 04-294125 | A | 10/1992 |
| JP | 2002-363463 | A | 12/2002 |
| JP | 2003-072086 | A | 3/2003 |
| JP | 2004-351923 | A | 12/2004 |
| JP | 2005-246905 | A | 9/2005 |
| JP | 2011-235477 | A | 11/2011 |

* cited by examiner

INK JET ETCHING METHOD AND INK JET PRINTING SYSTEM

BACKGROUND

1. Technical Field

The present invention relates to an ink jet etching method and an ink jet printing system.

2. Related Art

From the related art, as a technology of processing fiber, etching processing has been known in which a part of fiber configuring cloth (fabric) is broken and leached, and thus a watermark design is partially made, or a hole is opened. Such etching processing is able to be performed by using an ink jet system, and is able to be implemented by ejecting etching ink containing an etching agent from a nozzle of a recording head and by attaching the etching ink to the fabric.

As a technology similar to the etching processing, a printing technology using an ink jet system has been practically realized. Here, in the printing using the ink jet system, a technology of performing various expressions by changing a contrasting density of a color is disclosed in, for example, JP-A-63-066386, JP-A-63-072585, and JP-A-2005-246905.

In JP-A-63-066386 and JP-A-63-072585, a technology of changing a contrasting density of a color by using discharge printing is disclosed. In addition, in JP-A-2005-246905, a technology of changing a contrasting density of a color according to an ink amount is disclosed.

It is convenient when the printing technology disclosed in JP-A-63-066386, JP-A-63-072585, and JP-A-2005-246905 described above is also able to be applied to the etching processing. However, the etching processing is different from the discharge printing processing in that the contrasting density has to be expressed by changing a thickness of cloth, and thus it is not realistic to divert the printing technology in this state.

For example, when the technology disclosed in JP-A-63-066386 or JP-A-63-072585 is diverted to the etching processing, it is necessary that a plurality of printing is performed to thick cloth, and thus not only does it take time, but also an image is easily deviated, and it is extremely difficult to perform the etching processing.

SUMMARY

An advantage of some aspects of the invention is to express an etching gradation with respect to various cloth (fabrics), or to perform etching processing with high accuracy by reducing a position deviation of removing fiber by etching.

The invention can be realized in the following forms or application examples.

APPLICATION EXAMPLE 1

According to this application example, there is provided an ink jet etching method including etching fabric by using an ink set including first etching ink containing an etching agent, and second etching ink containing the etching agent in which a concentration of the etching agent is lower than a concentration of the etching agent in the first etching ink, in which etching fabric includes ejecting the first etching ink is ejected from two or more nozzle arrays among a plurality of nozzle arrays included in a recording head.

In this case, it is possible to express an etching gradation (a gradation) with respect to various fabrics. In addition, it is possible to perform etching processing with high accuracy by reducing a position deviation of removing the fiber by using the etching.

The "etching" in the invention indicates that fiber is broken and leached by using an etching agent. The etching processing in a narrow definition may indicate processing in which a part of fabric formed of single fiber is leached and broken, and thus a hole is opened, and the invention is not limited to such etching processing in a narrow definition. The invention includes opal processing in which only a part of fibers selected from fabric formed of a plurality of union fibers is leached and broken, and thus a watermark design is made on cloth.

APPLICATION EXAMPLE 2

In the ink jet etching method according to Application Example 1, the concentration of the etching agent in the first etching ink may be greater than or equal to four times of the concentration of the etching agent in the second etching ink.

In this case, it is possible to more excellently express the etching gradation.

APPLICATION EXAMPLE 3

In the ink jet etching method according to Application Example 1 or 2, the ink set may further include third etching ink in which a concentration of the etching agent is lower than the concentration of the etching agent in the second etching ink.

In this case, it is possible to more precisely express the etching gradation.

APPLICATION EXAMPLE 4

In the ink jet etching method according to any one of Application Examples 1 to 3, the first etching ink may be ejected from three or more nozzle arrays among the plurality of nozzle arrays disposed in the recording head.

In this case, it is possible to further widen a width of the etching gradation, or it is possible to sufficiently perform the etching with respect to fabric having a high fiber density or thick fabric.

APPLICATION EXAMPLE 5

In the ink jet etching method according to any one of Application Examples 1 to 4, the etching agent may be at least one selected from sulfuric acid, sodium hydrogen sulfate, aluminum sulfate, and ammonium sulfate.

In this case, etching properties are excellent with respect to fabric including fiber which is easily leached by the etching agent exhibiting acidic properties in water.

APPLICATION EXAMPLE 6

In the ink jet etching method according to Application Example 5, the etching agent may be aluminum sulfate.

In this case, it is possible to make etching properties excellent and to increase an effect of suppressing corrosion of a nozzle plate in the recording head, and it is possible to make excellent etching properties and excellent stability of the etching processing compatible.

APPLICATION EXAMPLE 7

In the ink jet etching method according to Application Example 5 or 6, the fabric may include cellulose-based fiber.

In this case, it is possible to preferably perform the etching with respect to the cellulose-based fiber.

APPLICATION EXAMPLE 8

In the ink jet etching method according to any one of Application Examples 1 to 4, the etching agent may to be at least one of a hydroxide of alkali metal and a guanidine weak acid salt.

In this case, etching properties are excellent with respect to fiber which is easily leached by the etching agent exhibiting basic properties in water.

APPLICATION EXAMPLE 9

In the ink jet etching method according to Application Example 8, the fabric may include at least one of polyamide-based fiber and polyester-based fiber.

In this case, it is possible to preferably perform the etching with respect to the polyamide-based fiber and the polyester-based fiber.

APPLICATION EXAMPLE 10

In the ink jet etching method according to any one of Application Examples 1 to 9, a content of the etching agent included in the first etching ink is may be greater than or equal to 10 mass %.

In this case, it is possible to further widen a width of the etching gradation, or it is possible to sufficiently perform the etching with respect to fabric having a high fiber density or thick fabric.

APPLICATION EXAMPLE 11

In the ink jet etching method according to any one of Application Examples 1 to 10, ink containing the etching agent may be ejected from the recording head which contains fluorine in at least a part of a nozzle plate surface and has a siloxane bond in a region of less than 1 μm from the nozzle plate surface.

In this case, it is possible to perform the etching processing with high corrosion resistance of the nozzle plate in the recording head and stability for a long period of time.

APPLICATION EXAMPLE 12

According to this application example, there is provided an ink jet printing system including a recording head including a plurality of nozzle arrays adapted to eject ink to fabric; and an ink set including first etching ink containing an etching agent, and second etching ink containing the etching agent in which a concentration of the etching agent is lower than a concentration of the etching agent in the first etching ink, in which the first etching ink is supplied such that the first etching ink is ejected from two or more nozzle arrays among the plurality of nozzle arrays.

In this case, it is possible to express the etching gradation with respect to various fabrics. In addition, it is possible to perform the etching processing with high accuracy by reducing the position deviation of removing the fiber by the etching.

APPLICATION EXAMPLE 13

In the ink jet printing system according to Application Example 12, the recording head may include a nozzle plate in which the plurality of nozzle arrays are provided, and the nozzle plate may have fluorine in at least a part of a nozzle plate surface and has a siloxane bond in a region of less than 1 μm from the nozzle plate surface.

In this case, it is possible to perform the etching processing with high corrosion resistance of the nozzle plate in the recording head and stability for a long period of time.

APPLICATION EXAMPLE 14

In the ink jet printing system according to Application Example 12 or 13, the etching agent may be aluminum sulfate.

In this case, it is possible to make excellent etching properties and excellent stability of the etching processing over a long period of time compatible.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
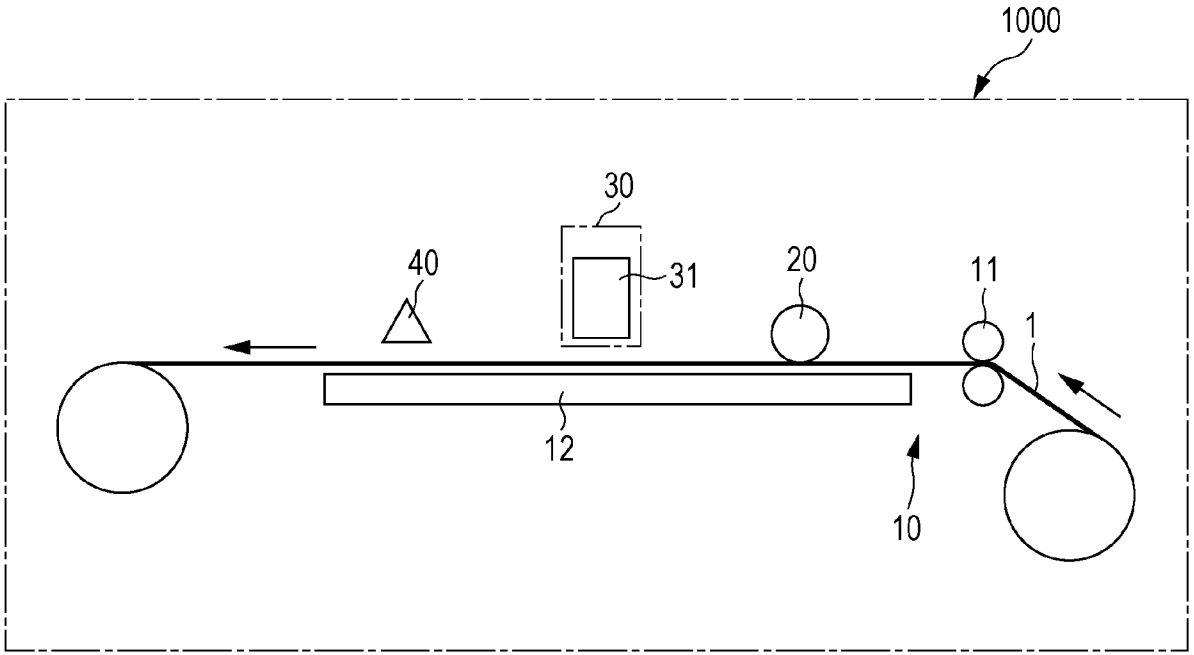
FIG. 1 is a diagram schematically illustrating an ink jet printing system according to one embodiment of the invention.

Hereinafter, preferred embodiments of the invention will be described. The embodiments described later are examples of the invention. In addition, the invention is not limited to the following embodiments, and includes various modification examples to be implemented within a range not departing from the gist of the invention. Furthermore, the entirety of the following configuration is not an essential configuration of the invention.

1. Ink Jet Etching Method

An ink jet etching method according to one embodiment of the invention includes an etching step of etching fabric by using an ink set including first etching ink containing an etching agent, and second etching ink containing the etching agent in which a concentration of the etching agent is lower than a concentration of the etching agent in the first etching ink, in which the first etching ink is ejected from two or more nozzle arrays among a plurality of nozzle arrays disposed in a recording head.

Hereinafter, the ink jet etching method according to this embodiment will be described in the order of an ink set, fabric, and a process.

1.1. Ink Set

The ink jet etching method according to this embodiment is performed by using an ink set including first etching ink and second etching ink. As a more preferred aspect of the ink set according to this embodiment, third etching ink is included in addition to the first etching ink and the second etching ink. Hereinafter, components which are included in each etching ink and components which are able to be included in each etching ink will be described. Furthermore, the ink is usually supplied from an ink cartridge or an ink tank. In this embodiment, the first etching ink, the second etching ink, and the third etching ink may not be stored in only one of each ink cartridge or ink tank one by one. For example, the first etching ink may be stored in two or more ink cartridges or ink tanks. The same applies to the second etching ink and the third etching ink.

1.1.1. First Etching Ink

The ink set according to this embodiment includes the first etching ink.

Etching Agent

The first etching ink contains an etching agent. The etching agent has a function of breaking and leaching (etching) fiber configuring fabric. As the etching agent, an etching agent exhibiting acidic properties or basic properties in water is able to be suitably selected and used according to fiber to be etched.

As an etching agent exhibiting acidic properties in water (hereinafter, simply referred to as "an acidic etching agent"), for example, hydrochloric acid, sulfuric acid, nitric acid, and salts thereof are included, and sulfuric acid and a salt of sulfuric acid (for example, sodium hydrogen sulfate, aluminum sulfate, ammonium sulfate, iron sulfate, copper sulfate, zinc sulfate, tin sulfate, and the like) are preferably used from a point of being excellent at etching cellulose-based fiber, and sulfuric acid, sodium hydrogen sulfate, aluminum sulfate, and ammonium sulfate are more preferably used. These acidic etching agents may be independently used, or two or more thereof may be used together.

As an etching agent exhibiting basic properties in water (hereinafter, simply referred to as a "basic etching agent"), guanidine and a salt thereof, a hydroxide of alkali metal (lithium, sodium, potassium, and the like), a hydroxide of alkali earth metal (calcium, barium, and the like), and the like are included, and a hydroxide of alkali metal (for example, sodium hydroxide, potassium hydroxide, lithium hydroxide, and the like), and a guanidine weak acid salt (for example, guanidine carbonate, guanidine acetate, and the like) are preferably used from a point of being excellent at etching polyamide fiber or polyester fiber. These basic etching agents may be independently used, or two or more thereof may be used together.

It is necessary that a concentration of the etching agent in the first etching ink is higher than a concentration of the etching agent in the second etching ink described later, it is preferable that a content of the etching agent in the first etching ink is greater than or equal to four times of a content of the etching agent in the second etching ink, and it is more preferable that the content of the etching agent in the first etching ink is greater than or equal to four times and less than or equal to ten times of the content of the etching agent in the second etching ink. Accordingly, it is possible to more excellently express an etching gradation (a gradation).

The content of the etching agent in the first etching ink is preferably greater than or equal to 10 mass % with respect to a total mass (100 mass %) of the first etching ink, is more preferably greater than or equal to 10 mass % and less than or equal to 40 mass %, and is further more preferably greater than or equal to 20 mass % and less than or equal to 30 mass %. By setting the content of the etching agent to be greater than or equal to 10 mass %, a capability of leaching the fiber is further improved. In addition, by setting the content of the etching agent to be less than or equal to 40 mass %, a viscosity of the first etching ink is easily set to be in a range suitable for an ink jet system, and it is possible to make ejection stability of a recording head excellent. Further, the first etching ink easily coexists with a solvent or a surfactant agent to be used together.

Water

The first etching ink contains water. Water is a liquid medium which is a main component of the first etching ink. It is preferable that the water is pure water or ultrapure water in which ionic impurities are extremely removed from water such as ion exchange water, ultrafiltration water, reverse osmosis water, and distillated water. A content of water is able to be, for example, greater than or equal to 40 mass % with respect to the total mass of the first etching ink.

Organic Solvent

The first etching ink may contain an organic solvent from a viewpoint of improving moisture retaining properties and permeability with respect to the fabric. As the organic solvent, for example, 1,2-alkane diols, polyhydric alcohols, glycol ethers, pyrrolidone derivatives, and the like are included.

As the 1,2-alkane diols, for example, 1,2-propane diol, 1,2-butane diol, 1,2-pentane diol, 1,2-hexane diol, 1,2-octane diol, and the like are included. The 1,2-alkane diols have an excellent action of increasing wettability of the ink with respect to the fabric and uniformly wetting the fabric. When the 1,2-alkane diols are contained, a content of the 1,2-alkane diols is able to be greater than or equal to 1 mass % and less than or equal to 10 mass % with respect to the total mass of the first etching ink.

As the polyhydric alcohols (excluding the 1,2-alkane diols described above), for example, ethylene glycol, diethylene glycol, propylene glycol, dipropylene glycol, 1,3-propane diol, 1,4-butane diol, 1,6-hexane diol, trimethylol propane, triethylene glycol, glycerin, and the like are included. The polyhydric alcohols have a function of increasing wettability of the ink with respect to the fabric, increasing moisture retaining properties of the nozzle, or the like. When the polyhydric alcohols are contained, a content of the polyhydric alcohols is able to be greater than or equal to 1 mass % and less than or equal to 20 mass % with respect to the total mass of the first etching ink.

As the glycol ethers, for example, ethylene glycol monoisobutyl ether, ethylene glycol monohexyl ether, ethylene glycol monoisohexyl ether, diethylene glycol monobutyl ether, diethylene glycol monomethyl ether, diethylene glycol monohexyl ether, triethylene glycol monobutyl ether, triethylene glycol monomethyl ether, triethylene glycol monoethyl ether, triethylene glycol monohexyl ether, diethylene glycol monoisohexyl ether, triethylene glycol monoisohexyl ether, ethylene glycol monoisoheptyl ether, diethylene glycol monoisoheptyl ether, triethylene glycol monoisoheptyl ether, ethylene glycol monooctyl ether, ethylene glycol monoisooctyl ether, diethylene glycol monoisooctyl ether, triethylene glycol monoisooctyl ether, ethylene glycol mono-2-ethyl hexyl ether, diethylene glycol mono-2-ethyl hexyl ether, triethylene glycol mono-2-ethyl hexyl ether, diethylene glycol mono-2-ethyl pentyl ether, ethylene glycol mono-2-ethyl pentyl ether, ethylene glycol mono-2-ethyl hexyl ether, diethylene glycol mono-2-ethyl hexyl ether, ethylene glycol mono-2-methyl pentyl ether, diethylene glycol mono-2-methyl pentyl ether, propylene glycol monobutyl ether, dipropylene glycol monobutyl ether, tripropylene glycol monobutyl ether, propylene glycol monopropyl ether, dipropylene glycol monopropyl ether, tripropylene glycol monomethyl ether, and the like are included. One of these is able to be independently used or two or more thereof are able to be used by being mixed. The glycol ethers are able to control wettability of the ink with respect to the fabric, or the like. When the glycol ethers are contained, a content of the glycol ethers is able to be greater than or equal to 1 mass % and less than or equal to 10 mass % with respect to the total mass of the first etching ink.

As the pyrrolidone derivatives, for example, N-methyl-2-pyrrolidone, N-ethyl-2-pyrrolidone, N-vinyl-2-pyrrolidone, 2-pyrrolidone, N-butyl-2-pyrrolidone, 5-methyl-2-pyrrolidone, and the like are included. The pyrrolidone derivatives have a function of increasing solubility of other solvents or moisture retaining properties of the ink. When the pyrrolidone derivatives are contained, a content of the pyrrolidone derivatives is able to be greater than or equal to 1 mass % and less than or equal to 20 mass % with respect to the total mass of the first etching ink.

Surfactant Agent

The first etching ink may contain a surfactant agent. The surfactant agent has a function of adjusting wettability between the ink and the fabric by decreasing surface tension of the ink. Among the surfactant agents, an acetylene glycol-based surfactant agent, an anionic surfactant agent, a silicone-based surfactant agent, and a fluorine-based surfactant agent are able to be preferably used.

The acetylene glycol-based surfactant agent is not particularly limited, and as the acetylene glycol-based surfactant agent, for example, Surfynol 104, 104E, 104H, 104A, 104BC, 104DPM, 104PA, 104PG-50, 104S, 420, 440, 465, 485, SE, SE-F, 504, 61, DF37, CT111, CT121, CT131, CT136, TG, GA, and DF110D (trade names, manufactured by Air Products and Chemicals. Inc.), Olfine B, Y, P, A, STG, SPC, E1004, E1010, PD-001, PD-002W, PD-003, PD-004, PD-005, EXP. 4001, EXP. 4036, EXP. 4051, AF-103, AF-104, AK-02, SK-14, and AE-3 (trade names, manufactured by Nissin Chemical Industry Co., Ltd.), and Acetylenol E00, E00P, E40, and E100 (trade names, manufactured by Kawaken Fine Chemicals Co., Ltd.) are included.

The anionic surfactant agent is not particularly limited, and as the anionic surfactant agent, for example, Pelex SS-H, and SS-L, Latemul WX, and E-150, Neopelex GS, G-15, G-25, and G-35 (trade names, manufactured by Kao Corporation), and the like are included.

The silicone-based surfactant agent is not particularly limited, and as the silicone-based surfactant agent, a polysiloxane-based compound is preferably included. The polysiloxane-based compound is not particularly limited, as the polysiloxane-based compound, for example, a polyether modified organosiloxane is included. As a commercialized product of the polyether modified organosiloxane described above, for example, BYK-306, BYK-307, BYK-333, BYK-341, BYK-345, BYK-346, and BYK-348 (trade names, manufactured by BYK-Chemie GmbH), KF-351A, KF-352A, KF-353, KF-354L, KF-355A, KF-615A, KF-945, KF-640, KF-642, KF-643, KF-6020, X-22-4515, KF-6011, KF-6012, KF-6015, and KF-6017 (trade names, manufactured by Shin-Etsu Chemical Co., Ltd.) are included.

As the fluorine-based surfactant agent, a fluorine modified polymer is preferably used, and as a specific example thereof, BYK-340 (manufactured by BYK Chemie Japan KK) is included.

When the surfactant agent is contained, a content of the surfactant agent is able to be greater than or equal to 0.05 mass % and less than or equal to 1.5 mass % with respect to the total mass of the first etching ink.

Other Components

The first etching ink may contain various additive agents such as ureas, saccharides, a pH adjusting agent, a chelating agent, an antiseptic agent, a mildew proofing agent, and a rust preventive agent, as necessary.

1.1.2. Second Etching Ink

The ink set according to this embodiment includes second etching ink. The second etching ink may be supplied to one nozzle array among the plurality of nozzle arrays of the recording head described later, or may be supplied to two or more nozzle arrays.

A specific example, a content range, a function, and an effect of components which are included in the second etching ink and components which are able to be included in the second etching ink are identical to that of the first etching ink except that a concentration of the etching agent is different, and thus the description thereof will be omitted.

It is necessary that the concentration (a content) of the etching agent in the second etching ink is lower than the concentration of the etching agent in the first etching ink, and specifically, is preferably greater than or equal to 3 mass % and less than or equal to 10 mass % with respect to a total mass of the second etching ink, and is more preferably greater than or equal to 5 mass % and less than or equal to 10 mass %. Accordingly, it is possible to more excellently express an etching gradation.

1.1.3. Third Etching Ink

It is preferable that the ink set according to this embodiment includes third etching ink. The third etching ink may be supplied to one nozzle array among the plurality of nozzle arrays of the recording head described later, or may be supplied to two or more nozzle arrays.

A concentration (a content) of the etching agent in the third etching ink is lower than the concentration of the etching agent in the first etching ink, and is lower than the concentration of the etching agent in the second etching agent. Accordingly, it is possible to more precisely express an etching gradation.

A specific example, a content range, a function, and an effect of components which are included in the third etching ink and components which are able to be included in the third etching ink are identical to that of the first etching ink except that the concentration of the etching agent is different, and thus the description thereof will be omitted.

The concentration (the content) of the etching agent in the third etching ink is lower than the concentration of the etching agent in the second etching agent, and specifically, is preferably greater than or equal to 0.5 mass % and less than or equal to 5 mass %, and is more preferably greater than or equal to 1 mass % and less than or equal to 5 mass %. Accordingly, it is possible to more precisely express an etching gradation.

1.1.4. Other Inks

The ink set according to this embodiment may include ink other than the etching ink described above. As this ink, normal color ink (for example, black ink, cyan ink, magenta ink, yellow ink, and the like) used for fabric printing is included.

The color ink is able to contain the same components as that of each of the etching inks described above except that the color ink contains a colorant and does not contain the etching agent described above, and thus the description of the components which are able to be commonly used will be omitted.

The colorant, for example, various colorants such as a direct colorant, an acidic colorant, a food colorant, a basic colorant, a reactive colorant, a dispersion colorant, a vat colorant, a soluble vat colorant, and a reactive dispersion colorant which are used for normal ink jet printing are able to be used.

1.1.5. Preparing Method of Ink

Each ink included in the ink set according to this embodiment is able to be obtained by mixing the components described above in an arbitrary order, and as necessary, by removing impurities using filtration or the like. As a mixing method of each component, a method is preferably used in which materials are sequentially added to a container provided with a stirring device such as a mechanical stirrer or a magnetic stirrer, and are stirred and mixed. As a filtering method, centrifugal filtration, filter filtration, and the like are able to be performed, as necessary.

1.1.6. Physical Properties of Ink

Surface tension of each of the inks included in the ink set according to this embodiment at 20° C. is preferably greater than or equal to 20 mN/m and less than or equal to 40 mN/m from a viewpoint of a balance with reliability as ink jet ink, and is more preferably greater than or equal to 23 mN/m and less than or equal to 38 mN/m. Furthermore, the surface tension, for example, is able to be measured by confirming surface tension when a platinum plate is wetted with ink under an environment of 20° C. using an automatic surface tensiometer CBVP-Z (trade name, manufactured by Kyowa Interface Science Co., Ltd.).

In addition, a viscosity of each of the inks at 20° C. is preferably greater than or equal to 1.5 mPa·s and less than or equal to 10 mPa·s from the same viewpoint, and is more preferably greater than or equal to 2 mPa·s and less than or equal to 8 mPa·s. Furthermore, the viscosity is able to be measured, for example, by using a viscoelastic testing machine MCR-300 (trade name, manufactured by Pysica Inc.) under an environment of 20° C.

1.2. Fabric

An ink jet etching method according to this embodiment is applied to the fabric. As the fabric according to this embodiment, fabric formed only of fiber which is able to be easily leached by a specific etching agent, or fabric including fiber which is easily leached by a specific etching agent and fiber which is less likely to be leached is used.

As a specific example of fiber which is easily leached by the acidic etching agent described above, cellulose fiber (for example, cotton, linen, rayon, and the like), and the like are included. On the other hand, as a specific example of fiber which is less likely to be leached by the acidic etching agent, for example, polyester fiber, polyamide fiber, wool, silk, and the like are included.

As a specific example of fiber which is easily leached by the basic etching agent described above, polyester fiber (for example, polyethylene terephthalate, and the like), polyamide fiber (an ϵ-caprolactam polymer, a condensate of hexamethylene diamine and adipic acid, silk, sheep wool, nylon, and the like), or the like are included. On the other hand, as a specific example of fiber which is less likely to be leached by the basic etching agent, cellulose fiber, and the like are included.

The fabric according to this embodiment may include fiber such as sheep wool, silk, polyolefin, acetate, triacetate, polyurethane, and polylactic acid.

When the fabric according to this embodiment includes two or more fibers, the fibers may be twisted or blended. As the fabric, the fiber described above may be in any shape of textile, knit, bonded textile, and the like. A fabric thickness, a fiber density, or the like is not particularly limited.

1.3. Process

The ink jet etching method according to this embodiment includes a process of etching the fabric by using the ink set described above. Hereinafter, processes which are included in the ink jet etching method according to this embodiment and processes which are able to be included in the ink jet etching method according to this embodiment will be described.

1.3.1. Pre-Processing Step

The ink jet etching method according to this embodiment may include a pre-processing step of applying a pre-processing agent to the fabric prior to an etching step. In the pre-processing step, in order to reduce bleeding or accelerate penetration of the ink to the fabric, a pre-processing agent including a water soluble polymer (a paste) is able to be applied.

As a natural water soluble polymer among the water soluble polymers, for example, starches such as corn, and wheat, cellulose derivatives such as carboxymethyl cellulose, methyl cellulose, and hydroxyethyl cellulose, polysaccharides such as sodium alginate, guar gum, tamarind gum, locust bean gum, and arabic gum, protein substances such as gelatin, casein, and keratin, and the like are included. In addition, as a synthetic water soluble polymer, for example, polyvinyl alcohol, polyvinyl pyrrolidone, an acrylic acid-based polymer, and the like are included.

The pre-processing agent may contain water, a cationic substance (for example, a water soluble metal salt, a polycationic compound), a surface tension adjusting agent (a surfactant agent), and the like.

The pre-processing agent is able to be applied, for example, by using any method such as a padding method, coating method, spraying method, and ink jet method.

Furthermore, when the pre-processing step is not performed, the ink jet etching method according to this embodiment may be performed by using fabric to which the pre-processing agent described above is applied in advance.

The ink jet etching method according to this embodiment may include a pre-processing agent drying step of drying the pre-processing agent applied to the fabric. The pre-processing agent drying step is able to be performed, for example, by using a device applying heat to the fabric, a device blowing wind to the fabric, a device of a combination thereof, and the like. Specifically, forced air heating, radiation heating, conductive heating, high frequency drying, microwave drying, and the like are preferably used.

1.3.2. Etching Step

The ink jet etching method according to this embodiment includes an etching step of etching the fabric by using the ink set described above. Specifically, the etching step is a step in which the etching ink described above is ejected from the nozzle array of the recording head, and liquid droplets of the etching ink are attached to a desired position of the fabric.

In the etching step of the ink jet etching method according to this embodiment, the etching ink is able to be attached to a desired position of the fabric by using an ink jet recording method. Accordingly, a position deviation of removing (leaching) the fiber is reduced, and thus it is possible to perform etching processing with high accuracy.

In addition, a plurality of etching inks having different concentrations of the etching agent is included, and thus it is possible to express an etching gradation.

Here, in the etching step, it is necessary that the first etching ink is able to be ejected from two or more nozzle arrays, and it is preferable that the first etching ink is able to be ejected from three or more nozzle arrays. Accordingly, it is possible to sufficiently leach the fiber, and thus it is possible to further widen a width of the etching gradation, or it is possible to sufficiently perform the etching with respect to the fabric having a high fiber density or thick fabric. Further, it is possible to attach the etching ink to the fabric over a wide range, and thus it is possible to express an etching gradation with respect to various fabrics.

The ink jet recording method may be any method, and as the ink jet recording method, an electron deflection method, a continuous method, on-demand method (a Piezo type, and a Bubble Jet (registered trademark) type), and the like are included. Among these ink jet recording methods, a method using a Piezo type ink jet recording device is particularly preferable.

An amount per one liquid droplet of the etching ink ejected from the nozzle array is preferably greater than or equal to 1 ng and less than or equal to 40 ng, and is more preferably greater than or equal to 5 ng and less than or equal to 30 ng. By setting the amount per one liquid droplet to be in the range described above, an area of the liquid droplets at the time of being attached to the fabric is in a suitable range, and thus it is possible to perform the etching with respect to a region planned to be etched cleanly.

1.3.3. Printing Step

The ink jet etching method according to this embodiment may include a printing step of performing fabric printing by using color ink. In the printing step, liquid droplets of the color ink are ejected from the nozzle array (a nozzle opening portion) of the recording head and are attached to the fabric, and thus at least a part of fiber existing in a desired position of the fabric is dyed. Accordingly, it is possible to form an image in a predetermined position of the fabric.

The printing step is able to be implemented before the etching step described above, at the same time as the etching step, or after the etching step.

The liquid droplets of the color ink may be attached to any position in an etched region (a region planned to be etched when the etching step is not yet performed), or in a region which is not etched (a non-etched region).

A jet recording method in the printing step is identical to the jet recording method described in the etching step described above, and thus the description thereof will be omitted.

1.3.4. Moist Heating Step

It is preferable that the ink jet etching method according to this embodiment includes a wet heat treatment step. The wet heat treatment step is a step in which a wet heat treatment is performed with respect to the etching ink attached to the fabric. Accordingly, at least a part of the fiber existing in a portion to which the etching ink is attached is leached, and thus the fiber is incinerated. The wet heat treatment is performed after the etching step. In general, a simple drying step may be performed after the etching step and before the wet heat treatment.

The wet heat treatment step is able to be performed by using a known method of the related art, and as the method, for example, an HT method (a high temperature steaming method), an HP method (a high pressure steaming method), and the like are included.

A temperature or a time of the wet heat treatment step is set within a range in which it is possible to make leaching and damage reducing of the fabric compatible. The temperature or the time of the wet heat treatment step is changed according to the type of fiber, the type of etching agent, an added amount of the etching agent, and the like.

1.3.5. Other Steps

The ink jet etching method according to this embodiment may include a cleaning step of cleaning the fabric after the moist heating step. Accordingly, it is possible to effectively remove the leached fiber or an unconsumed colorant. The cleaning step may be performed by using water (hereinafter, referred to as a "water cleaning treatment"), by using an aqueous solution containing water and a surfactant agent (thermal soap or the like) (hereinafter, referred to as a "soaping treatment"), or by using both of the treatments together.

In addition, the cleaning step may include a water jet treatment in order to more effectively remove the leached fiber. The water jet treatment forcibly removes the leached fiber by using a water pressure, and is able to be implemented by a known method.

The ink jet etching method according to this embodiment may include a fabric drying step of drying the fabric after the cleaning step. The fabric drying step is able to be performed by using a device exemplified in the pre-processing agent drying step described above, and thus the description thereof will be omitted.

The ink jet etching method according to this embodiment may include a knot ink applying step. The knot ink applying step is a step in which knot ink containing a knot binder is applied, and is performed after the etching step. Accordingly, it is possible to suppress fiber fraying in an etched portion of the fabric.

As the knot binder, a known component of the related art is able to be used. The knot ink is able to be applied by using any method such as a padding method, a coating method, a spraying method, and an ink jet method.

2. Ink Jet Printing System

An ink jet printing system according to one embodiment of the invention includes the recording head including a plurality of nozzle arrays adapted to eject ink to fabric, and the ink set described above, in which the first etching ink is able to be ejected from two or more nozzle arrays among the plurality of nozzle arrays.

The ink jet printing system according to this embodiment implements the ink jet etching method described above. Hereinafter, an example of the ink jet printing system according to this embodiment will be described with reference to the drawings. Furthermore, the ink jet printing system according to this embodiment is not limited to the following aspects.

FIG. 1 is a diagram schematically illustrating an ink jet printing system 1000 according to this embodiment. The ink jet printing system 1000 includes a transport device 10 transporting fabric, a pre-processing device 20 applying a pre-processing agent to a surface of the fabric, an ink ejection device 30 ejecting etching ink and color ink, and a wet heat treatment device 40 performing a wet heat treatment with respect to an image. In FIG. 1, the ink jet printing system 1000 is illustrated by an aspect in which all of the pre-processing, the ink ejection (an etching treatment or a printing treatment), and the wet heat treatment are implemented in one manufacturing device, but a part of these treatments may be implemented in other manufacturing devices. For example, the ink jet printing system 1000 is able to be provided with a first manufacturing device including the pre-processing device 20 and the ink ejection device 30, and a second manufacturing device including the wet heat treatment device 40. In addition, each of the pre-processing, the ink ejection (the etching treatment or the printing treatment), and the wet heat treatment may be independently implemented in the other manufacturing device. For example, the ink jet printing system 1000 is able to be provided with a first manufacturing device including the pre-processing device 20, a second manufacturing device including the ink ejection device 30, and a third manufacturing device including the wet heat treatment device 40.

The ink jet printing system 1000 according to this embodiment includes a control device (not illustrated) controlling the entire operation of the ink jet printing system 1000 described above. The control device is disposed in an arbitrary position of the ink jet printing system 1000, and for example, controls the operation of each device on the basis of information input from an input device such as a PC or a touch panel.

2.1. Transport Device

The transport device 10 is able to be configured of a roller 11. The transport device 10 may include a plurality of rollers 11. In an illustrated example, the transport device 10 is disposed on an upstream side of the pre-processing device 20 in a direction in which fabric 1 is transported (shown by an arrow in the drawing, and hereinafter, referred to as a "fabric transport direction"), but the disposition of the transport device 10 is not limited thereto, and a position or the number of transport devices 10 to be disposed is arbitrary insofar as the fabric 1 is able to be transported.

Further, the transport device 10 may include various platens or the like. In an example of FIG. 1, the transport device 10 includes a platen 12 which supports the fabric 1 from a surface opposite to a surface of the fabric 1 to which ink is attached in addition to the roller 11.

2.2. Pre-Processing Device

The pre-processing device 20 applies the pre-processing agent described above to the surface of the fabric. The pre-processing device 20 is a means for implementing the pre-processing step described above. In the example of FIG. 1, the pre-processing device 20 is disposed on an upstream side of the ink ejection device 30 in the fabric transport direction.

As a method of applying the pre-processing agent to the surface of the fabric, any method such as a padding method, a coating method, a spraying method, and an ink jet method is able to be used, and in the example of FIG. 1, a method (a coating method) of applying a treatment agent by a roll coater is illustrated.

The ink jet printing system 1000 according to this embodiment may include a pre-processing agent drying device (not illustrated) drying the pre-processing agent applied to the fabric. The pre-processing agent drying device is able to be disposed on a downstream side of the pre-processing device 20 and on the upstream side of the ink ejection device 30. A specific example of such a drying device is as described in the pre-processing agent drying step described above, and thus the description thereof will be omitted.

When the pre-processing is not performed or fabric subjected to the pre-processing is used, the ink jet recording device 1000 according to this embodiment may not include the pre-processing device 20 and the pre-processing agent drying device.

2.3. Ink Ejection Device

The ink ejection device 30 performs fabric etching or fabric printing by using the ink set described above. The ink ejection device 30 is a means for implementing the etching step and the printing step described above. In the example of FIG. 1, the ink ejection device 30 is disposed on the downstream side of the pre-processing device 20 in the fabric transport direction.

The ink ejection device 30 includes a recording head 31 in which a plurality of nozzle arrays ejecting each ink (etching ink or color ink) is disposed. The recording head 31 of FIG. 1 is a so-called serial head, ejects the ink from the nozzle array while reciprocating in a direction intersecting with the fabric transport direction in a planar view of the fabric, and attaches the ink to a desired position of the fabric 1.

Figure 2:
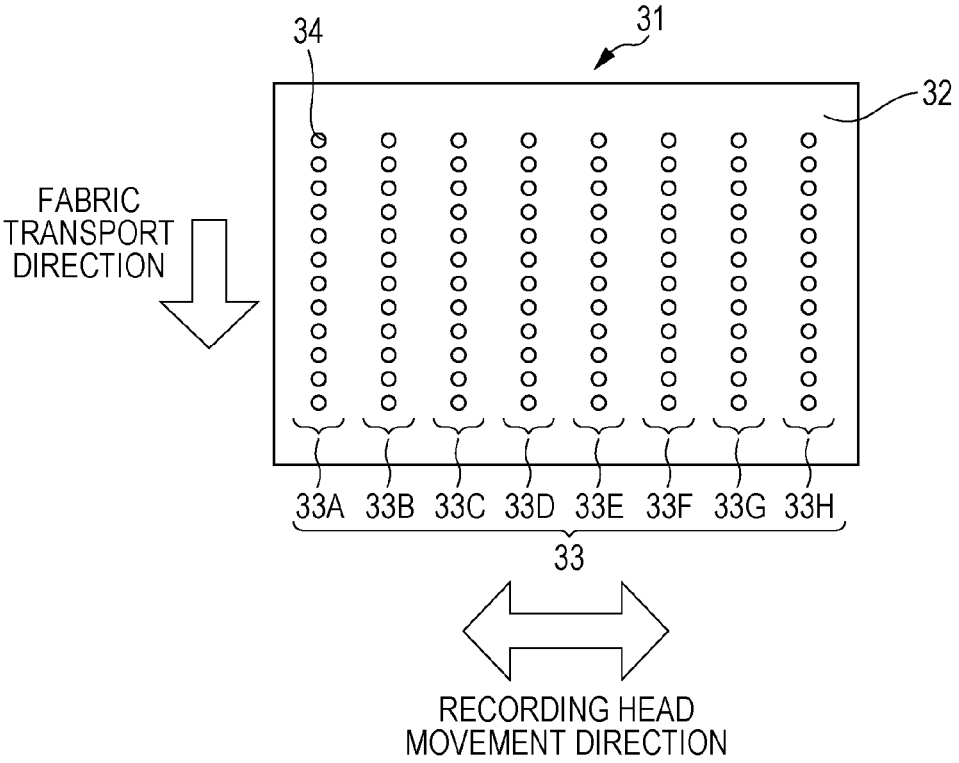
FIG. 2 is a diagram schematically illustrating a nozzle surface of a recording head in an ink jet printing system according to one embodiment of the invention.

FIG. 2 is a schematic view illustrating a nozzle surface 32 of the recording head 31. As illustrated in FIG. 2, the recording head 31 includes the nozzle surface 32. The nozzle surface 32 which is an ejection surface of the ink is arranged in a position facing the fabric 1. In the nozzle surface 32, a plurality of nozzle arrays 33 is arranged. The plurality of nozzle arrays 33 includes a plurality of nozzle opening portions 34 for ejecting the ink in each nozzle array.

In the plurality of nozzle arrays 33, each of the inks described above is supplied to each nozzle array such that the ink is able to be ejected. In an example of FIG. 2, nozzle arrays 33A to 33H are disposed, and each nozzle array is arranged along the fabric transport direction. Specifically, the nozzle arrays 33A to 33H are arranged such the nozzle arrays 33A and 33B are able to eject the first etching ink, the nozzle array 33C is able to eject the second etching ink, the nozzle array 33D is able to eject the third etching ink, the nozzle array 33E is able to eject yellow ink, the nozzle array 33F is able to eject magenta ink, the nozzle array 33G is able to eject cyan ink, and the nozzle array 33H is able to eject black ink. Furthermore, the order of arranging the nozzle arrays ejecting each of the inks is not limited thereto, and is able to be suitably selected.

In the example of FIG. 2, a case where the number of nozzle arrays is eight is illustrated, but the number of nozzle arrays is not particularly limited insofar as the number of nozzle arrays adapted to eject at least the first etching ink is two and the number of nozzle arrays adapted to eject the second etching ink is one.

In the example of FIG. 2, each of the nozzle arrays 33A to 33H is formed to extend in the fabric transport direction in the nozzle surface 32, but the formation of the nozzle array is not limited thereto, and each of the nozzle arrays 33A to 33H may be arranged at an angle in the direction intersecting with the fabric transport direction in the nozzle surface 32.

The plurality of nozzle opening portions 34 is arranged in a predetermined pattern, and thus each of the nozzle arrays is formed. In this embodiment, the plurality of nozzle opening portions 34 is arranged in parallel in the fabric transport direction in the nozzle surface 32, but the arrangement of the nozzle opening portion is not limited thereto, and the nozzle opening portion is able to be arranged in a desired pattern. Furthermore, the number of nozzle opening portions 34 configuring each of the nozzle arrays is not particularly limited.

As described above, the serial head type printer (a recording device) is mainly described, but the invention is not limited to this aspect. Specifically, a line head type printer in which recording heads are immobilized and are sequentially arranged in a fabric transport direction, or a lateral type printer including a head (a carriage) in which a movement device which is moved in an X direction and a Y direction (a main scanning direction and an auxiliary scanning direction) is disposed as disclosed in JP-A-2002-225255 may be used. An example is surepressL-4033A (manufactured by Seiko Epson Corporation) which is a lateral type printer.

In the ink jet printing system 1000 according to this embodiment, it is possible to attach the etching ink to a desired position of the fabric by using the ink jet recording method. Accordingly, a position deviation of removing (leaching) the fiber is reduced, and thus it is possible to perform the etching processing with high accuracy.

In addition, a plurality of etching inks having different concentrations of the etching agent is included, and thus it is possible to express an etching gradation. Here, according to the ink jet printing system 1000 of this embodiment, the first etching ink is able to be ejected from two or more nozzle arrays. Accordingly, it is possible to sufficiently leach the fiber, and thus it is possible to further widen a width of the etching gradation, or it is possible to sufficiently perform the etching with respect to fabric having a high fiber density and thick fabric. Further, it is possible to attach the etching ink to the fabric over a wide range, and thus it is possible to express an etching gradation with respect to various fabrics.

A specific example of the ink jet recording method is as described in the etching step described above, and thus the description thereof will be omitted.

In the ink jet printing system 1000 according to this embodiment, a case where the etching ink and the color ink are ejected by using the same recording head 31 is described, but the invention is not limited thereto, and a recording head ejecting etching ink and a recording head ejecting color ink may be separately included.

Figure 3:
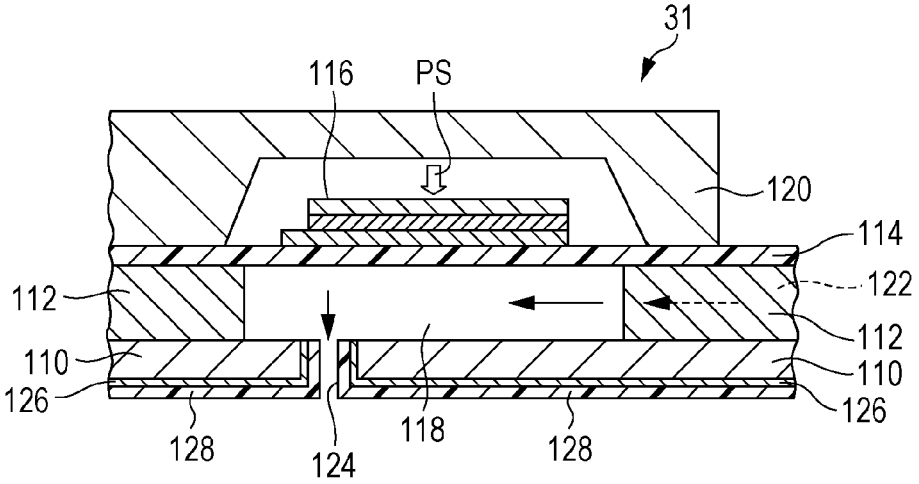
FIG. 3 is a cross-sectional view schematically illustrating an example of a recording head according to one embodiment of the invention.

The recording head 31 includes a nozzle plate including the nozzle surface 32 on which the nozzle array 33 is formed. FIG. 3 is a cross-sectional view schematically illustrating an example of the recording head. The recording head 31 illustrated in FIG. 3 is configured of a main member such as a nozzle plate 110, a pressure chamber substrate 112, a vibration plate 114, and a piezoelectric element 116. The pressure chamber substrate 112 is disposed on the nozzle plate 110, and the pressure chamber substrate 112 is partitioned, and thus a pressure chamber 118 is formed. The vibration plate 114 having flexibility is disposed on the pressure chamber substrate 112, and the vibration plate 114 is bent, and thus it is possible to instantaneously increase an internal pressure of the pressure chamber 118. A piezoelectric element 116 is disposed on the vibration plate 114 in a position corresponding to the pressure chamber 118. The entire piezoelectric element 116 is covered with a cover 120.

An ink inlet port (not illustrated) introducing the ink described above into the head is disposed in the pressure chamber substrate 112. The ink inlet port is connected to an ink storage (not illustrated), and the ink storage is formed to be able to store the ink. In addition, the ink storage communicates with the pressure chamber 118 through a flow path 122, and the ink ejection side of the pressure chamber 118 is connected to an ink ejection port 124 (the nozzle opening portion 34) disposed in the nozzle plate 110. A material of the nozzle plate 110 is not particularly limited, and as the material, stainless steel (for example, SUS or the like), polyimide, and the like are able to be used.

In addition, the nozzle plate 110 may include fluorine in at least a part of a surface. Further, the nozzle plate 110 may have a siloxane bond in a region of less than 1 μm from the surface. In an example of FIG. 3, a plasma polymerized film 126 and a fluorine resin film 128 are formed on the surface of the nozzle plate 110 and an inner surface of the ink ejection port 124. Furthermore, the "nozzle plate surface" includes a film which is physically or chemically processed in order to change properties of at least a part of the surface of the nozzle plate.

When the material of the nozzle plate 110 is stainless steel, the plasma polymerized film 126 is able to be formed on the surface of the nozzle plate 110 and the inner surface of the ink ejection port 124 by performing a plasma polymerization with respect to a silicone material. As a raw material of the plasma polymerized film 126, silicone oil, alkoxysilane such as dimethyl polysiloxane are included. As a specific commercial product, TSF451 (manufactured by GE-Toshiba Silicones Corporation), SH200 (manufactured by Dow Corning Toray Silicone Co., Ltd.), and the like are included.

In addition, the fluorine resin film 128 having liquid repellency is able to be formed on the surface of the plasma polymerized film 126. It is preferable that such a fluorine resin film 128 is a monomolecular film of alkoxysilane having long chain macromolecular chain containing fluorine. As the long chain macromolecular chain containing fluorine, a perfluoroalkyl chain, a perfluoropolyether chain, and the like of which a molecular weight is greater than or equal to 1000 are included. As the alkoxysilane having a long chain macromolecular chain, for example, a silane coupling agent having the above-exemplified long chain macromolecular chain, and the like are included. As the silane coupling agent, for example, heptatriaconta fluoroicosyl trimethoxysilane and the like are included, and as a commercialized product, Optool DSX (trade name, manufactured by Daikin Industries Ltd.), KY-130 (trade name, manufactured by Shin-Etsu Chemical Co., Ltd.), and the like are included. Furthermore, when the material of the nozzle plate 110 is polyimide, the plasma polymerized film 126 may not be formed but the fluorine resin film 128 may be directly formed on the nozzle plate 110.

Figure 4:
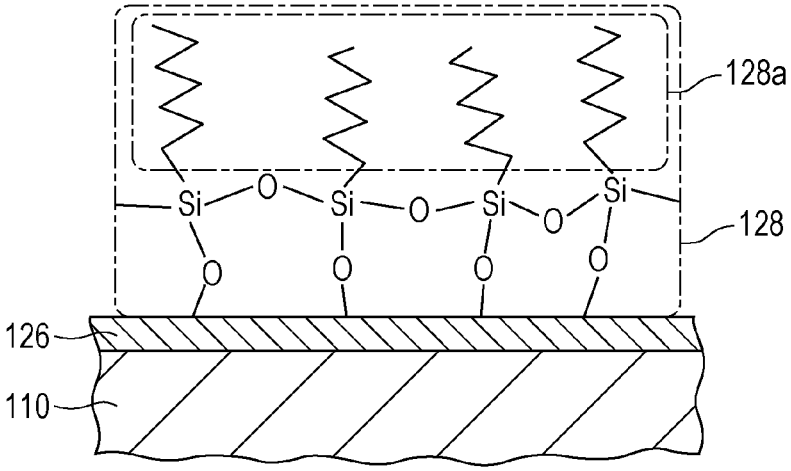
FIG. 4 is a conceptual diagram of a bond in a fluorine resin film on a nozzle plate surface.

FIG. 4 is a conceptual diagram of the fluorine resin film 128 formed on the plasma polymerized film 126. When the nozzle plate 110 is immersed in a solution of alkoxysilane having a long chain macromolecular chain containing fluorine, the fluorine resin film 128 in which alkoxysilane having a long chain macromolecular chain containing fluorine is polymerized is formed on the surface of the plasma polymerized film 126 on the nozzle plate 110. A silicon atom of the fluorine resin film 128 is bonded to the plasma polymerized film 126 through an oxygen atom (a so-called siloxane bond). For this reason, a long chain macromolecular chain containing fluorine **128*a* is positioned on the surface side. At this time, the fluorine resin film 128 is in a state where silicon atoms are three-dimensionally bonded, and the long chain macromolecular chains containing fluorine are intricately intertwined. For this reason, the fluorine resin film 128 has a high density, and thus it is difficult for the ink to penetrate the fluorine resin film 128. Such a recording head 31 includes the fluorine resin film 128 which is a monomolecular film, and thus a siloxane bond is included in the region of less than 1 μm from the outermost surface of the nozzle plate 110**.

On the other hand, an eutectoid plating film of a nickel ion and a fluorine resin is formed on the surface of the nozzle plate 110, and thus fluorine may be included in at least a part of the surface of the nozzle plate 110. Such an eutectoid plating film is able to be formed by an electrolytic method or an electroless method, but the method is not particularly limited, and for example, a method is preferably used in which a nozzle plate surface is immersed in an electrolytic solution where nickel ions and high molecular resin particles having liquid repellency are dispersed by an electric charge, and the immersed nozzle plate surface is subjected to eutectoid plating while stirring the solution. As a material of the high molecular resin having liquid repellency which is used in the eutectoid plating, it is preferable that resins such as polytetrafluoroethylene (PTFE), polyperfluoroalkoxy butadiene, polyfluorovinylidene, polyfluorovinyl, and polydiperfluoroalkyl fumarate are independently used or are used by being mixed. In addition, a metal material used in the eutectoid plating is not limited to nickel, and for example, copper, silver, tin, zinc, or the like is able to be suitably selected. It is more preferable that the metal material used in the eutectoid plating is a material such as nickel, a nickel-cobalt alloy, or a nickel-boron alloy which has high surface hardness and excellent wear resistance.

Furthermore, the nozzle plate 110 on which the plasma polymerized film 126 and the fluorine resin film 128 described above are formed has extremely excellent corrosion resistance with respect to any of the ink containing the acidic etching agent and the ink containing the basic etching agent as described later.

In addition, as an index indicating easiness of corrosion of the nozzle plate, a concentration (pH) of hydrogen ions in the etching ink is considered. That is, it is generally considered that when acidic ink is used, corrosion of the nozzle plate easily occurs as a pH value becomes lower, and when alkalic ink is used, corrosion of the nozzle plate easily occurs as the pH value becomes higher. However, it has been found that when the plasma polymerized film 126 and the fluorine resin film 128 are formed on the surface of the nozzle plate, corrosion resistance is not necessarily correlated with the pH value of the ink. This will be verified by the following examples.

2.4. Wet Heat Treatment Device

The wet heat treatment device 40 performs a wet heat treatment with respect to the fabric. The wet heat treatment device 40 is a means for implementing the wet heat treatment step described above. In the example of FIG. 1, the wet heat treatment device 40 is disposed on the downstream side of the ink ejection device 30 in the fabric transport direction. In the wet heat treatment, a known method of the related art is able to be used, and as the method, for example, an HT method (a high temperature steaming method), an HP method (a high pressure steaming method), and the like are included. Furthermore, as described above, in general, a simple drying step may be performed after the etching step and before the wet heat treatment. Therefore, the ink jet printing system 1000 according to this embodiment may include a simple drying device between the ink ejection device 30 and the wet heat treatment device 40 as a means for implementing the simple drying step.

2.5. Other Device

The ink jet printing system 1000 according to this embodiment may further include a cleaning device (not illustrated) for cleaning the fabric. The cleaning device is a means for implementing the cleaning step described above. As the cleaning device, a known device is able to be used. The cleaning device, for example, is able to be disposed on a downstream side of the wet heat treatment device 40 described above in the fabric transport direction.

The ink jet printing system 1000 according to this embodiment may further include a fabric drying device (not illustrated) for drying the fabric. As the fabric drying device, a drying device identical to that described in the pre-processing agent drying device described above is able to be used. The fabric drying device, for example, is able to be disposed on the downstream side of the wet heat treatment device 40 (when the fabric is cleaned by the cleaning device, the fabric drying device is able to be disposed on a downstream side of the cleaning device).

The ink jet printing system according to this embodiment may further include a knot ink applying device. The knot ink applying device is a device implementing the knot ink applying step described above, and for example, is able to be disposed on the downstream side of the ink ejection device 30. In the knot ink applying device, any method such as a padding method, a coating method, a spraying method, and an ink jet method is also able to be adopted.

3. EXAMPLES

Hereinafter, the invention will be described on the basis of examples in more detail, but the invention is not limited to these examples.

3.1. Preparation of Etching Ink

Each component was input into a container to have a composition of Table 1, the components were mixed and stirred by a magnetic stirrer for 2 hours, then were filtered by a membrane filter having a hole diameter of 5 μm, and thus etching inks A1, B1, C1, A2, B2, and C2 were obtained. Furthermore, a numerical value in Table 1 indicates mass %, and ion exchange water was added such that a total mass of the etching ink is 100 mass %.

The etching inks A1 and A2 correspond to the first etching ink, the etching inks B1 and B2 correspond to the second etching ink, and the etching inks C1 and C2 correspond to the third etching ink.

Furthermore, among the components shown in Table 1, components described by trade name are as follows.

Olfine E1010 (trade name, manufactured by Nissin Chemical Industry Co., Ltd., an acetylene glycol-based surfactant agent)

Proxel XL2 (trade name, manufactured by Avecia Inc., an antiseptic agent)

TABLE 1

| | Material | Etching Ink A1 | Etching Ink B1 | Etching Ink C1 | Etching Ink A2 | Etching Ink B2 | Etching Ink C2 |
|---|---|---|---|---|---|---|---|
| Etching Agent | Aluminum Sulfate 14-18 Hydrate | 20 | 5 | 2 | — | — | — |
| | Guanidine Carbonate | — | — | — | 25 | 5 | 2 |
| Moisturizing Agent | 2-Pyrrolidone | 10 | 10 | 10 | 10 | 10 | 10 |
| Penetrating Agent | Triethylene Glycol Monobutyl Ether (Butyl Triglycol) | 3 | 3 | 3 | 3 | 3 | 3 |
| Surfactant Agent | Olfine E1010 | 0.3 | 0.3 | 0.3 | 0.3 | 0.3 | 0.3 |
| Antiseptic Agent | Proxel XL2 | 0.3 | 0.3 | 0.3 | 0.3 | 0.3 | 0.3 |
| Water | Ion Exchange Water | Remaining Amount | Remaining Amount | Remaining Amount | Remaining Amount | Remaining Amount | Remaining Amount |
| Total (mass %) | | 100 | 100 | 100 | 100 | 100 | 100 |

3.2. Evaluation Test

In the following evaluation tests, an ink jet printer which was adjusted as follows was used. First, an ink chamber of an exclusive cartridge of an ink jet printer PM-G800 (trade name, manufactured by Seiko Epson Corporation) was filled with each of the etching inks shown in Table 1. Then, an ink set of the etching inks in which the etching inks of Table 2 and Table 3 were combined was mounted in the printer, and each ink was supplied to correspond to a nozzle array shown in Table 2 and Table 3.

3.2.1. Fabric

Fabric X and fabric Y were used for etching ink containing an acidic etching agent (aluminum sulfate 14-18 hydrate). Fabric Z and fabric X were used for etching ink containing a basic etching agent (guanidine carbonate).

Fabric X (trade name of "E/C Blend Opal III", manufactured by Tanakanao Senryoten, thin cloth, a material: cotton of 50%, and polyester of 50%)

Fabric Y (trade name of "E/C Linen Blend Opal", manufactured by Tanakanao Senryoten, thick cloth, a material: linen, polyester, and cotton; a mixing ratio thereof is unclear)

Fabric Z (trade name of "Linen Blend No. 0801", manufactured by Chori Co., Ltd., a material: polyester of 22%, rayon of 56%, and linen of 22%)

3.2.2. Pattern for Evaluation

Figure 5:
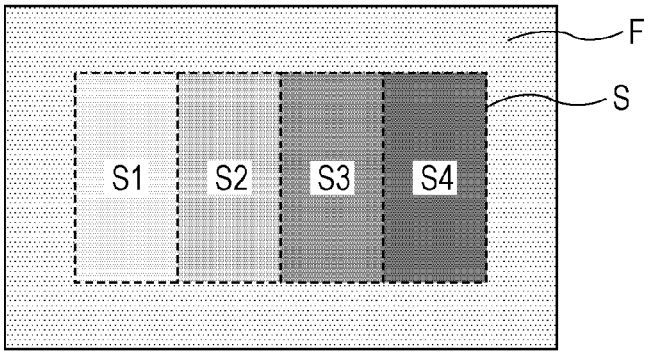
FIG. 5 is an explanatory diagram schematically illustrating an evaluation pattern according to an example.

As a pattern for evaluation, each of the fabrics X, Y, and Z was etched into a pattern as illustrated in FIG. 5. The pattern for evaluation includes a region (an etching region) S in which etching is performed inside a surface of the fabrics X, Y, and Z. The etching region S is surrounded by a region (a non-etched region) F in which the etching is not performed. The etching region S is divided into four regions of which removing ratios of the fiber to be removed are different from each other. Hereinafter, the fiber to be removed by the etching will be referred to as "etching target fiber", and a removing ratio of the etching target fiber will be referred to as a "fiber removing ratio". In addition, the fiber which is not removed by the etching will be referred to as "no etching target fiber". The etching region S is divided into a first region S1 of which a fiber removing ratio is 100%, a second region S2 of which a fiber removing ratio is 75%, a third region S3 of which a fiber removing ratio is 50%, and a fourth region S4 of which a fiber removing ratio is 25%.

When the etching ink contains the acidic etching agent, the etching target fiber is cotton, and when the etching ink contains the basic etching agent, the etching target fiber is polyester. The ink set of Table 2 contains the acidic etching agent, and thus cotton is the etching target fiber. The ink set of Table 3 contains the basic etching agent, and thus polyester is the etching target fiber.

3.2.3. Preparation of Evaluation Sample

First, the etching ink was ejected from the printer and attached the etching ink to the fabric such that the pattern for evaluation described above was formed (the etching step). The etching step was performed in a condition of image resolution having a length of 720 dpi×a width of 720 dpi and Duty of 100%.

After that, steaming was performed at 170° C. for 10 minutes (the wet heat treatment step), then cleaning was performed at 90° C. for 10 minutes by using an aqueous solution including 0.2 mass % of a surfactant agent (trade name of "Laccol STA", manufactured by Meisei Chemical Works, Ltd.) (the cleaning step), and drying was performed at 60° C. for 30 minutes, and thus an evaluation sample was obtained.

3.2.4. Concave and Convex Gradation

The regions S1 to S4 of the evaluation sample was directly visually observed. In addition, an enlarged picture of the evaluation sample was prepared, and the regions S1 to S4 were observed by using the enlarged picture. The enlarged picture was prepared at a magnification at which a distance between gratings of the no etching target fiber of the fibers configuring the fabrics X, Y, and Z was approximately 1 mm to 3 mm, that is, at a magnification at which the grating of the no etching target fiber was able to be sufficiently grasped.

Evaluation criteria are as follows.

A: In a visual observation, a gradation (a difference in a thickness or a contrasting density of the cloth) due to the etching of the first region S1, the second region S2, the third region S3, and the fourth region S4 is obvious. In addition, a boundary between adjacent regions, that is, a boundary between the first region S1 and the region S2, a boundary between the region S2 and the region S3, and a boundary between the region S3 and the region S4 are obvious.

B: In the visual observation, a gradation due to the etching of the first region S1, the second region S2, the third region S3, and the fourth region S4 is able to be recognized. However, the boundary between the adjacent regions is slightly unobvious.

C: In the visual observation, a difference in the thickness or the contrasting density of the cloth of the first region S1, the second region S2, the third region S3, and the fourth region S4 is obscure. The boundary between the adjacent regions is also unobvious. In the enlarged picture, a difference in the thickness or the contrasting density between the cloth and the other region in a part of each of the regions S1 to S4 is tentatively confirmed.

D: A gradation due to the etching is not able to be recognized at all. The boundary between the adjacent regions is not also able to be recognized at all. Even in the enlarged picture, a difference in the thickness or the contrasting density of the cloth between the respective regions S1 to S4 is not confirmed.

3.2.5. Removing Entire Etching Target Fiber

The first region S1 of the evaluation sample was directly visually observed. In addition, the first region was confirmed by using an enlarged picture. A magnification of the enlarged picture is as described in the concave and convex gradation described above. Furthermore, as described above, when the etching ink contains the acidic etching agent, the etching target fiber is cotton, and when the etching ink contains the basic etching agent, the etching target fiber is polyester. The ink set of Table 2 contains the acidic etching agent, and thus cotton is the etching target fiber. The ink set of Table 3 contains the basic etching agent, and thus polyester is the etching target fiber.

Evaluation criteria are as follows.

A: The etching target fiber is able to be barely recognized in the visual observation or in the enlarged picture.

B: An existence of a part of the etching target fiber is confirmed in the observation using the enlarged picture, but is not able to be recognized in the visual observation.

C: An existence of a part of the etching target fiber is confirmed in the visual observation.

D: An existence of most of the etching target fiber is confirmed in the visual observation.

3.2.6. Cleanliness of Boundary Region

A boundary between the first region S1 and a non-etched region F of the evaluation sample was directly visually confirmed. In addition, the boundary was observed by using an enlarged picture. A magnification of the enlarged picture is as described in the concave and convex gradation described above.

Evaluation criteria are as follows.

A: A boundary between the first region S1 and the non-etched region F is obvious in the visual observation or in the enlarged picture. In the observation using the enlarged picture, it is possible to confirm that an end portion of the etching target fiber in the non-etched region F is cleanly cut in this boundary portion.

B: In the visual observation, the boundary between the first region S1 and the non-etched region F is obvious. In the observation using the enlarged picture, it is confirmed that the end portion of the etching target fiber in the non-etched region F is slightly insufficiently cut, and a cut end of the etching target fiber is inserted into the first region S1 from the non-etched region F.

C: In the visual observation, it is confirmed that the cut end of the etching target fiber is inserted into the first region S1 from the non-etched region F, and the boundary between the first region S1 and the non-etched region F is slightly obscure.

D: In the visual observation, it is confirmed that the cut end of the etching target fiber is considerably inserted into the first region S1 from the non-etched region F, and the boundary between the first region S1 and the non-etched region F is extremely obscure.

3.3. Evaluation Result

Results of the following evaluation tests are shown in Table 2 and Table 3.

TABLE 2

| | | | Example 1 | Example 2 | Example 3 | Example 4 | Comparative Example 1 | Comparative Example 2 | Comparative Example 3 | Comparative Example 4 |
|---|---|---|---|---|---|---|---|---|---|---|
| Type of Ink Corre-sponding to Each Nozzle Array (Ink Set) | | Bk Ink Array | Etching Ink A1 | Etching Ink A1 | Etching Ink A1 | Etching Ink A1 | Etching Ink A1 | Etching Ink A1 | Etching Ink B1 | Etching Ink A1 |
| | | Y Ink Array | Etching Ink A1 | Etching Ink A1 | Etching Ink A1 | Etching Ink A1 | Etching Ink B1 | Etching Ink A1 | Etching Ink B1 | Etching Ink C1 |
| | | M Ink Array | Etching Ink B1 | Etching Ink A1 | Etching Ink B1 | Etching Ink A1 | — | Etching Ink A1 | Etching Ink B1 | Etching Ink C1 |
| | | C Ink Array | Etching Ink B1 | Etching Ink A1 | — | Etching Ink B1 | — | Etching Ink A1 | Etching Ink B1 | Etching Ink C1 |
| | | LM Ink Array | Etching Ink C1 | Etching Ink B1 | — | Etching Ink B1 | — | — | — | — |
| | | LC Ink Array | Etching Ink C1 | Etching Ink C1 | — | — | — | — | — | — |
| Evaluation Result | Cloth X | Concave and Convex Gradation | A | B | B | B | C | D | C | C |
| | | Removing Entire Target Fiber | A | A | B | A | C | A | C | B |
| | | Cleanliness of Boundary Region | B | A | B | A | C | A | C | C |
| | Cloth Y | Concave and Convex Gradation | A | B | B | B | C | C | C | C |
| | | Removing Entire Target Fiber | B | A | B | B | C | A | D | C |
| | | Cleanliness of Boundary Region | B | A | B | B | D | A | D | D |

TABLE 3

| | | | Example 5 | Example 6 | Example 7 | Example 8 | Comparative Example 5 | Comparative Example 6 | Comparative Example 7 | Comparative Example 8 |
|---|---|---|---|---|---|---|---|---|---|---|
| Type of Ink Corre-sponding to Each Nozzle Array (Ink Set) | | Bk Ink Array | Etching Ink A2 | Etching Ink A2 | Etching Ink A2 | Etching Ink A2 | Etching Ink A2 | Etching Ink A2 | Etching Ink B2 | Etching Ink A2 |
| | | Y Ink Array | Etching Ink A2 | Etching Ink A2 | Etching Ink A2 | Etching Ink A2 | Etching Ink B2 | Etching Ink A2 | Etching Ink B2 | Etching Ink C2 |
| | | M Ink Array | Etching Ink B2 | Etching Ink A2 | Etching Ink B2 | Etching Ink A2 | — | Etching Ink A2 | Etching Ink B2 | Etching Ink C2 |
| | | C Ink Array | Etching Ink B2 | Etching Ink A2 | — | Etching Ink B2 | — | Etching Ink A2 | Etching Ink B2 | Etching Ink C2 |
| | | LM Ink Array | Etching Ink C2 | Etching Ink B2 | — | Etching Ink B2 | — | — | — | — |
| | | LC Ink Array | Etching Ink C2 | Etching Ink C2 | — | — | — | — | — | — |
| Evaluation Result | Cloth Z | Concave and Convex Gradation | A | B | B | B | C | D | C | C |
| | | Removing Entire Target Fiber | A | A | B | A | C | A | C | B |

TABLE 3-continued

| | | Example 5 | Example 6 | Example 7 | Example 8 | Comparative Example 5 | Comparative Example 6 | Comparative Example 7 | Comparative Example 8 |
|---|---|---|---|---|---|---|---|---|---|
| | Cleanliness of Boundary Region | B | A | B | A | C | A | C | C |
| Cloth X | Concave and Convex Gradation | A | B | B | B | C | C | C | C |
| | Removing Entire Target Fiber | B | A | B | B | C | A | D | C |
| | Cleanliness of Boundary Region | B | A | B | B | D | A | D | D |

As in the evaluation results of Table 2 and Table 3, it was shown that when the ink set according to the examples was used, it was possible to perform etching processing having an excellent gradation, and it was able to sufficiently remove the target fiber over a wide range. In addition, it was shown that cleanliness of the boundary portion between the etching region and the non-etched region was excellent, and thus it was able to cleanly perform the etching.

Etching ink of Comparative Example 1 and Comparative Example 5 of which a concentration of an etching agent was high was ejected from only one nozzle array. For this reason, a concave and convex gradation was insufficiently expressed or the target fiber was insufficiently removed.

In Comparative Example 2 and Comparative Example 6, etching ink of which a concentration of an etching agent was high was used, and thus a concave and convex gradation due to the etching was insufficiently expressed.

In Comparative Example 3 and Comparative Example 7, only etching ink of which a concentration of an etching agent was a medium degree was used, and thus the target fiber was insufficiently removed by the etching or cleanliness of the boundary portion was insufficient.

In Comparative Example 4 and Comparative Example 8, etching ink of which a concentration of an etching agent was high was ejected from only one nozzle array, and thus a concave and convex gradation was insufficiently expressed or cleanliness of the boundary portion was insufficient.

3.4. Evaluation of Corrosion Resistance of Nozzle Plate 3.4.1. Preparation of Etching Ink Each component was input into a container to have a composition of Table 4, the components were mixed and stirred by a magnetic stirrer for 2 hours, then were filtered by a membrane filter having a hole diameter of 5 μm, and thus etching inks A3 and A4 were obtained. Furthermore, a numerical value in Table 4 indicates mass %, and ion exchange water was added such that a total mass of the etching ink is 100 mass %. Furthermore, the etching inks A3 and A4 correspond to the first etching ink. In addition, the etching ink A1 is identical to that of Table 1 described above. Among the components shown in Table 4, commercially available bisulfate (sodium hydrogen sulfate) was purchased and used as a test reagent. In addition, other components shown in Table 4 are identical to that of Table 1 described above.

TABLE 4

| | Material | Etching Ink A1 | Etching Ink A3 | Etching Ink A4 |
|---|---|---|---|---|
| Etching Agent | Aluminum Sulfate 14-18 Hydrate | 20 | | |
| | Disulfate | | 20 | |
| | Ammonium Sulfate | | | 20 |
| Moisturizing Agent | 2-Pyrrolidone | 10 | 10 | 10 |
| Penetrating Agent | Triethylene Glycol Monobutyl Ether (Butyl Triglycol) | 3 | 3 | 3 |
| Surfactant Agent | Olfine E1010 | 0.3 | 0.3 | 0.3 |
| Antiseptic Agent | Proxel XL2 | 0.3 | 0.3 | 0.3 |
| Water | Ion Exchange Water | Remaining Amount | Remaining Amount | Remaining Amount |
| Total (mass %) | | 100 | 100 | 100 |

In Table 4, measurement results of pH of each ink are as follows. The etching ink A1 (aluminum sulfate) has pH of 3.5, the etching ink A3 (bisulfate (sodium hydrogen sulfate)) has pH of 1.0, and the etching ink A4 (ammonium sulfate) has pH of 5.0.

3.4.2. Preparation of Nozzle Plate

As a nozzle plate in which a liquid repelling film was formed on a surface, a plurality of nozzle plates of which a surface was subjected to eutectoid plating, and a plurality of nozzle plates in which a plasma polymerized film and a fluorine resin film were formed on a surface were prepared.

As the nozzle plate subjected to the eutectoid plating, a nozzle plate which was obtained by immersing a nozzle plate of SUS316 in a plating liquid (nickel sulfate: 240 g/L, nickel chloride: 45 g/L, boric acid: 35 g/L, and PTFE: 50 g/L), and by performing eutectoid plating with respect to the nozzle plate while slowly stirring the liquid in a condition of pH of 4.0 to 4.5, a plating temperature of 60° C., and a negative electrode current density of 3 A/dm$^2$ was used.

On the other hand, as the nozzle plate on which the plasma polymerized film and the fluorine resin film were formed, a nozzle plate which was obtained by plasma polymerizing a nozzle plate of SUS316 with dimethyl polysiloxane (SH200 (manufactured by Dow Corning Toray Silicone Co., Ltd.)) to form a plasma polymerized film, and by forming a monomolecular film of heptatriaconta fluoroicosyl trimethoxysilane (Optool DSX (trade name, manufactured by Daikin Industries Ltd.)) was used. More specifically, the plasma polymerized film and the fluorine resin film were formed as follows.

A nozzle plate on which the film was not yet formed was introduced into a plasma polymerization chamber and maintained at 40° C., and argon gas was supplied to the chamber and maintained at 7 Pa. 100 W of high frequency power was applied, argon plasma was generated, dimethyl polysiloxane was introduced into the chamber, and a polymerization reaction occurred, and thus the plasma polymerized film was formed on the nozzle plate surface. Next, the plasma polymerized film was annealed at 200° C. in a nitrogen atmosphere. Next, a surface of the plasma polymerized film was exposed to the argon plasma for 1 minute. After that, the plasma polymerized film was exposed to the air, and a hydrogen atom was bonded to an oxygen atom terminating the surface of the plasma polymerized film, and thus an OH group was obtained. Heptatriaconta fluoroicosyltrimethoxysilane was mixed into a solvent (using a product name of HFE-7200 (manufactured by Sumitomo 3M Limited)) in advance, for example, a solution having a concentration of 0.1 wt % was prepared, the nozzle plate on which the plasma polymerized film was formed was heated at 300° C. and was immersed in the solution described above, and the nozzle plate on which the plasma polymerized film and the fluorine resin film were formed was obtained.

3.4.3. Evaluation Test

Evaluation 1

20 g of each of the etching inks A1, A3, and A4 was measured and contained in a Teflon (a registered trademark) container, the nozzle plate subjected to the eutectoid plating and the nozzle plate on which the plasma polymerized film and the fluorine resin film were formed were individually immersed in the ink, and the container was closed by a lid. The container was placed under a normal temperature environment for 1 day, 3 days, 5 days, and 7 days, then the nozzle plate was taken out, and results of visually observing a state of the liquid repelling film and results of comparing a time of repelling the etching ink with a time of repelling the etching in an initial state are shown in Table 5. Furthermore, when liquid repellency is degraded, it is difficult to repel the etching ink, and thus the ink repelling time increases.

Evaluation criteria are as follows.

A: The state of the liquid repelling film is identical to the initial state (before ink immersion), and there is no change. The ink repelling time does not increase.

B: There is no change in the liquid repelling film in appearance, but the ink repelling time increases.

C: There is a change in the liquid repelling film in appearance, and the ink repelling time increases.

D: The liquid repelling film is peeled off, the SUS plate is exposed, and the ink is not repelled.

TABLE 5

| Liquid | | Number of Immersion Days (RT) | | | |
|---|---|---|---|---|---|
| Repelling Film | Evaluation Ink | 1 Day | 3 Days | 5 Days | 7 Days |
| Eutectoid Plating | Etching Ink A1 | B | C | D | D |
| | Etching Ink A3 | C | D | D | D |
| | Etching Ink A4 | A | B | C | D |
| Plasma Polymerized Film and Fluorine Resin Film | Etching Ink A1 | A | A | A | A |
| | Etching Ink A3 | A | A | A | A |
| | Etching Ink A4 | A | A | A | A |

Evaluation 2

20 g of each of the etching inks A1, A3, and A4 was measured and contained in a Teflon (a registered trademark) container, the nozzle plate on which the plasma polymerized film and the fluorine resin film were formed was individually immersed in the ink, and the container was closed by a lid. The container was placed at 60° C. for 1 day, days, 7 days, and 14 days, and results of visually observing a state of the liquid repelling film are shown in Table 6. Evaluation criteria of Table 6 are identical to that of Table 5. Furthermore, Evaluation 2 corresponds to an acceleration test of Evaluation 1 described above.

TABLE 6

| Evaluation | Type of | Number of Immersion Days (60° C.) | | | |
|---|---|---|---|---|---|
| Ink | Etching Agent | 1 Day | 3 Days | 7 Days | 14 Days |
| Etching Ink A1 | Aluminum Sulfate pH = 3.5 | A | A | A | A |
| Etching Ink A3 | Disulfate pH = 1.0 | A | A | A | B |
| Etching Ink A4 | Ammonium Sulfate pH = 5.0 | A | B | B | C |

3.4.4. Evaluation Result

In Table 5, when the nozzle plate subjected to the eutectoid plating was immersed in the etching ink A3 (disulfate), a change in appearance was confirmed in 1 day. On the other hand, in the etching ink A1 (aluminum sulfate) and the etching ink A4 (ammonium sulfate), each change in appearance was confirmed in 3 days and in 5 days. Therefore, it is assumed that when the nozzle plate is subjected to the eutectoid plating, the number of days in which a change occurs in the appearance of the surface is changed according to the type of etching ink, and thus a usable period is changed. In addition, it was found that when the nozzle plate was subjected to the eutectoid plating, the number of days until the appearance of the surface was changed was prolonged as the pH of the etching ink became higher, and a degradation in the eutectoid plating had a linear functional correlation with the pH of the etching ink.

On the other hand, in Table 5, it was found that in the nozzle plate on which the plasma polymerized film and the fluorine resin film were formed, there was no change in appearance for 7 days with respect to any etching ink, and thus the nozzle plate had extremely excellent corrosion resistance.

On the other hand, in Table 6, it was confirmed that in the nozzle plate on which the plasma polymerized film and the fluorine resin film were formed, there was no change in appearance for greater than or equal to 7 days with respect to any etching ink, and there was a change in appearance in 14 days when the nozzle plate was immersed in the etching ink A4 (ammonium sulfate). Therefore, it was confirmed that the nozzle plate on which the plasma polymerized film and the fluorine resin film were formed had extremely excellent corrosion resistance with respect to any etching ink. In particular, it was found that when the nozzle plate was immersed in the etching ink A1 (aluminum sulfate), the state before the immersion was able to be maintained for greater than or equal to 14 days, and thus extremely excellent corrosion resistance was obtained.

In addition, from the results of Table 6, it was found that when the plasma polymerized film and the fluorine resin film were formed on the nozzle plate, the order of degradation according to the type of etching ink was not simply correlated with the pH of the etching ink. That is, it was found that the degradation occurred earlier in a case where the nozzle plate was immersed in the etching ink A4 (ammonium sulfate) of which the pH value was high than in a case where the nozzle plate was immersed in the etching ink A3 (disulfate) or the etching ink A1 (aluminum sulfate) of which the pH value was low. Therefore, it was found that the degradation in the plasma polymerized film and the fluorine resin film had a complicated correlation with the type of etching ink.

The invention is not limited to the embodiments described above, but is able to be variously changed. For example, the invention has a configuration which is substantially identical to the configuration described in the embodiments (for example, a configuration having the same function, the same method, and the same result, or a configuration having the same object and the same effect). In addition, the invention has a configuration in which an inessential portion of the configuration described in the embodiments is substituted. In addition, the invention has a configuration obtaining the same action effect as that of the configuration described in the embodiments or a configuration attaining the same object as that of the configuration described in the embodiments. In addition, the invention has a configuration in which a known technology is added to the configuration described in the embodiments.

The entire disclosure of Japanese Patent Application Nos. 2014-054539 filed on Mar. 18, 2014, 2014-063237 filed on Mar. 26, 2014 and 2014-236554 filed on Nov. 21, 2014 are expressly incorporated by reference herein.

What is claimed is:

1. An ink jet etching method, comprising:

etching fabric to form a concave and convex gradation in the fabric by using an ink set including first etching ink containing an etching agent to leach fibers that form the fabric, and second etching ink containing the etching agent in which a concentration of the etching agent is lower than a concentration of the etching agent in the first etching ink, wherein etching fabric includes ejecting the first etching ink from two or more nozzle arrays among a plurality of nozzle arrays included in a recording head, and ejecting the second etching ink from at least one other nozzle array among the plurality of nozzle arrays included in the recording head, wherein each of the first etching ink and the second etching ink do not contain a colorant.

2. The ink jet etching method according to claim 1, wherein the concentration of the etching agent in the first etching ink is greater than or equal to four times of the concentration of the etching agent in the second etching ink.

3. The ink jet etching method according to claim 1, wherein the ink set further includes third etching ink in which a concentration of the etching agent is lower than the concentration of the etching agent in the second etching ink.

4. The ink jet etching method according to claim 1, wherein the first etching ink is ejected from three or more nozzle arrays among the plurality of nozzle arrays disposed in the recording head.

5. The ink jet etching method according to claim 1, wherein the etching agent is at least one selected from sulfuric acid, sodium hydrogen sulfate, aluminum sulfate, and ammonium sulfate.

6. The ink jet etching method according to claim 5, wherein the etching agent is aluminum sulfate.

7. The ink jet etching method according to claim 5, wherein the fabric includes cellulose-based fiber.

8. The ink jet etching method according to claim 1, wherein the etching agent is at least one of a hydroxide of alkali metal and a guanidine weak acid salt.

9. The ink jet etching method according to claim 8, wherein the fabric includes at least one of polyamide-based fiber and polyester-based fiber.

10. The ink jet etching method according to claim 1, wherein a content of the etching agent included in the first etching ink is greater than or equal to 10 mass %.

11. The ink jet etching method according to claim 1, wherein ink containing the etching agent is ejected from the recording head which contains fluorine in at least a part of a nozzle plate surface and has a siloxane bond in a region of less than 1 μm from the nozzle plate surface.

12. The ink jet etching method according to claim 1, wherein the etching agent is a guanidine weak acid salt.

13. The ink jet etching method according to claim 1, further comprising a pre-processing step of applying a pre-processing agent to the fabric prior to the etching.

* * * * *